United States Patent [19]

Martin

[11] 4,392,381

[45] Jul. 12, 1983

[54] DRIVER BAR ASSEMBLY

[75] Inventor: Robert W. Martin, West Covina, Calif.

[73] Assignee: Kimball Industries, Inc., Monrovia, Calif.

[21] Appl. No.: 291,333

[22] Filed: Aug. 10, 1981

[51] Int. Cl.[3] ..... B06B 1/00; B06B 3/00

[52] U.S. Cl. ..... 73/663; 73/665; 73/662

[58] Field of Search ..... 73/660, 661, 662, 663, 73/664, 665, 666, 667

[56] References Cited

U.S. PATENT DOCUMENTS

| | | | |
|---|---|---|---|
| 3,208,270 | 9/1965 | Hill | 73/665 |
| 3,242,724 | 3/1966 | Ceparano et al. | 73/665 |
| 3,277,696 | 10/1966 | Gertel | 73/665 |
| 3,933,033 | 1/1976 | Kimball | 73/665 |
| 4,164,152 | 8/1979 | Lemonde et al. | 73/665 |
| 4,270,390 | 6/1981 | Kimball et al. | 73/663 |

*Primary Examiner*—Anthony V. Ciarlante

*Assistant Examiner*—David V. Carlson

*Attorney, Agent, or Firm*—Wagner & Bachand

[57] ABSTRACT

Driver bar assembly for vibration test apparatus, comprising a bar element and a retainer element separably connected thereto; the bar element having a normally vertically disposed base attachable to a pivotally mounted shaker head and a normally horizontally disposed flange adapted to lie in a common plane with and spaced from a slip plate to be driven by the shaker head; the retainer element having a first bracket in which the bar element flange is bracketable, and a second bracket in which the slip plate is bracketable opposite the bar element flange, whereby the flange and slip plate spacing is bridged in vibration transmitting relation between the shaker head and the slip plate; the retainer element being separable from the slip plate and the bar element flange without relative movement of the slip plate and shaker head, the bar element and shaker head being freely angularly movable relative to the slip plate in the separated condition of the retainer element and the bar element.

21 Claims, 8 Drawing Figures

DRIVER BAR ASSEMBLY

TECHNICAL FIELD

This invention has to do with vibration test apparatus, and more particularly with vibration test apparatus in which a test piece is carried on a slip plate, the slip plate being mounted for horizontal movement on a bearing table, and to which a shaker head is connected, for the purpose of controllably vibrating the test piece to evaluate its ultimate vibration tolerance, or to accelerate environmental vibration failures as a quality control step in manufacturing.

In vibration test apparatus the faithful replication of the shaker head vibration at the slip plate is ensured by the interposition of a driver bar which is coupled extensively to the vertically and horizontally distributed bolt pattern on the shaker head, and through an integral horizontal flange is coupled as well to the slip plate edge margin opposite the shaker head. Actual vibration transmission is generally through a series of split sleeve pins designed for the purpose which are mounted in registered, cooperating fastening apertures defined by the driver bar and the slip plate.

BACKGROUND ART

The shaker head apparatus is necessarily massive and heavy. Shakers are typically mounted on trunnions so that the head may be directed horizontally or vertically and thus the shaker head is carried for angular movement relative to the slip plate. The slip plate is supported on a bearing table atop a mass which is necessarily quite heavy and not ordinarily considered movable. In making a test set-up, the slip plate is fastened down carefully to the bearing table so that movement only in desired axes occurs. The driver bar coupled to the shaker head is jockeyed into place on the slip plate edge margin and the split sleeve pins inserted. The operation has typically required relative movement of the slip plate and shaker head, followed by fastening down of the slip plate. Any adjustment in the test set-up requires unbolting the slip plate, or movement of the shaker head. Because driver bars typically extend both over, and under, the slip plate edge margin, the shaker head cannot be simply tipped up out of the way. In U.S. Pat. No. 3,933,033, a solution to this problem was disclosed in the form of a cantilever driver bar. In certain applications, particularly small set-ups, the non center line to center line nature of the relationship of the driver bar flange and the slip plate is disadvantageous and thus there is a need to provide a driver bar which is convenient to use, like that of U.S. Pat. No. 3,933,033, but which drives the slip plate in opposed relation on a center line to center line basis in a common plane, without unwanted pitch moments.

DESCRIPTION OF THE INVENTION

It is therefore an object of the invention to provide an improved vibration test apparatus, and particularly a driver bar assembly which is convenient in set-up, and which drives the slip plate in opposed relation on a center line to center line manner between the shaker head and the slip plate. It is another object to provide a driver bar assembly of separable elements, for vibration testing, which is mountable and demountable from the test apparatus without need for relative displacement of the slip plate and shaker head. A still further object is provision of vibration test apparatus in which the shaker head is angularly movable on the shaker trunnions without need of unfastening the slip plate from the bearing table, and while providing over-under mounting of the driver bar to the slip plate against pitching of the slip plate.

These and other objects of the invention to become apparent hereinafter are realized in accordance therewith by provision of a river bar assembly comprising a bar element and a retainer element separably connected thereto; the bar element having a normally vertically disposed base attachable to a pivotally mounted shaker head and a normally horizontally disposed flange adapted to lie in a common plane with and spaced from a slip plate to be driven by the shaker head; the retainer element having first bracket means in which the bar element flange is bracketable, and second bracket means in which the slip plate is bracketable opposite the bar element flange, whereby the flange and slip plate spacing is bridged in vibration transmitting relation between the shaker head and the slip plate; the retainer element being separable from the slip plate and the bar element flange without relative movement of the slip plate and shaker head, the bar element and shaker head being freely angularly movable relative to the slip plate in the separated condition of the retainer element and the bar element.

In particular embodiments, the bar element base defines a distributed plurality of fastening means vertically spaced from the flange for fastening together the bar element base and the shaker head; the bar element flange and the retainer element define mutually registerable cooperating fastening means; the retainer element defines fastening means registerable and cooperative with slip plate fastening means; and the retainer element comprises a body having an H-shaped cross-section, the first and second brackets being defined by respective pairs of the legs of the body.

The invention contemplates therefore, vibration test apparatus comprising the driver bar assembly of the invention and including also a shaker head attached to the driver bar assembly in vibration transmitting relation; and including further a slip plate attached to the driver bar assembly in vibration receiving relation, the shaker head and slip plate being coupled together in vibration transmitting relation by the driver bar assembly.

In preferred embodiments of the driver bar assembly the retainer element comprises a body, the retainer element first bracket means comprises a pair of laterally and longitudinally extended legs cantilevered in parallel from a first side of the body and relatively spaced to slidably bracket the bar element flange, and the legs define opposed sets of fastener pin receiving apertures arranged to register with cooperating pin passing apertures on the bar element flange, whereby the legs are fastenable in vibration transmitting relation to the bar element flange. Further, the retainer element second bracket means typically comprises a pair of laterally and longitudinally extended legs cantilevered in parallel from a second side of the body and relatively spaced to slidably bracket the bar element flange, the legs defining opposed sets of fastener pin receiving apertures arranged to register with cooperating pin passing apertures on an edge margin of the slip plate, whereby the legs are fastenable in vibration transmitting relation to the slip plate.

In a particularly preferred embodiment of the driver bar assembly according to the invention, the retainer element comprises an H-shaped body, the retainer element first and second bracket means comprising laterally and longitudinally extended leg pairs oppositely cantilevered in parallel from first and second sides of the body and relatively sized and spaced to slidably bracket either the bar element flange or the edge margin of the slip plate, the leg pairs defining opposed sets of fastener pin receiving apertures arranged to register with cooperating pin passing apertures on the bar element flange or the slip plate edge margin bracketed thereby, whereby the body is leg-fastenable in vibration transmitting relation to the slip plate and the bar element; the driver bar assembly also includes pins fastening the retainer bar, slip plate and bar element flange together in vibration transmitting relation respectively at the apertures; the driver bar assembly retainer element is symmetrical about its longitudinal axis and also is symmetrical about its transverse axis.

There is further contemplated use of split sleeve pins for fastening the retainer bar, slip plate and bar element flange together in vibration transmitting relation.

In each of the various embodiments, it is preferred that the bar element base define a horizontally and vertically distributed plurality of fastening apertures above and below the flange for receiving shaker head bolts for fastening together the bar element base and the shaker head and that the retainer element be so constructed and arranged as to be endwise slidable onto the bar element flange and off the flange freely of relative movement of the bar element and the slip plate, and endwise slidable onto the slip plate edge margin and off the slip plate freely of relative movement of the slip plate and the bar element.

As in other embodiments, the preferred assembly is contemplated for use in vibration test apparatus comprising the driver bar assembly and including also a shaker head attached to the driver bar assembly in vibration transmitting relation, a slip plate attached to the driver bar assembly in vibration receiving relation, or a shaker head and a slip plate coupled together in vibration transmitting relation by the driver bar assembly.

THE DRAWINGS

The invention will be further described as to an illustrative embodiment in conjunction with the attached drawings in which.

PREFERRED MODES

Figure 2:
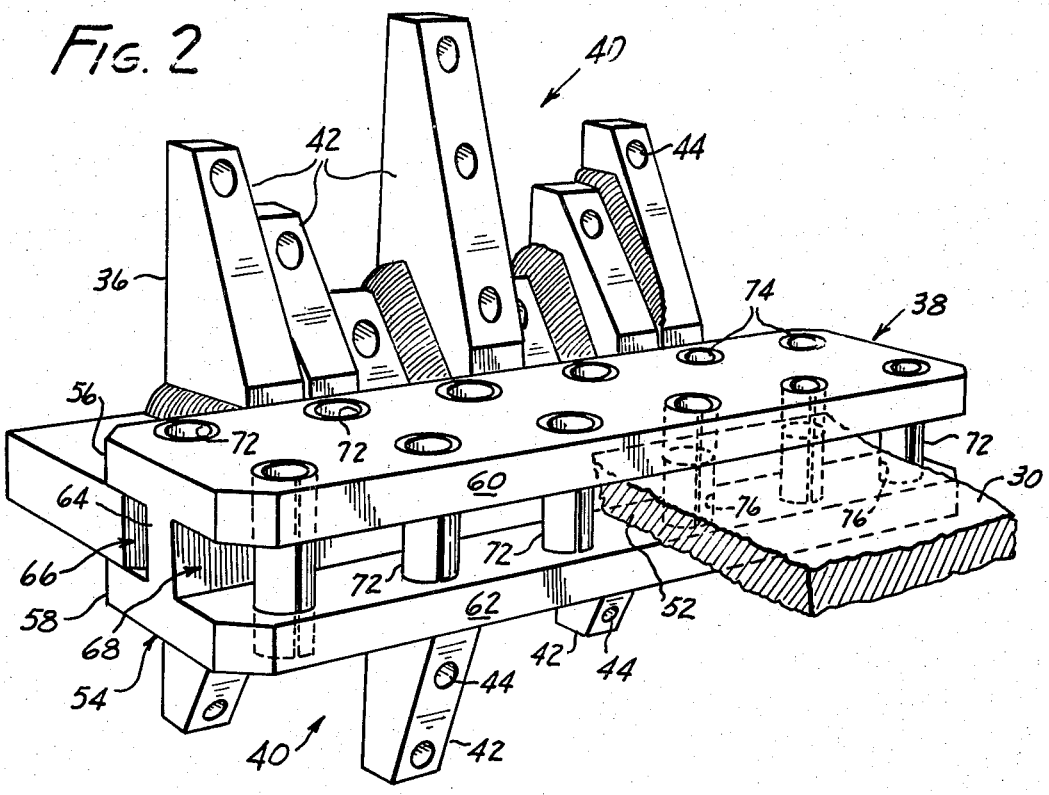
FIG. 2 is a perspective view of the driver bar assembly of the invention in assembled condition with split sleeve pins in place.
Figure 1:
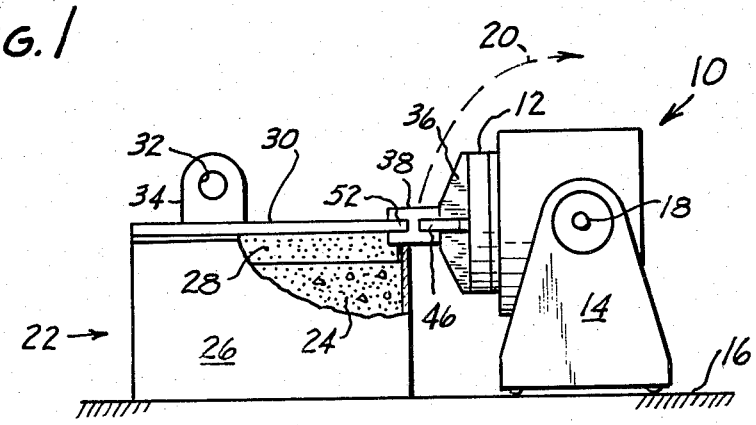
FIG. 1 is a side elevation view of vibration test apparatus having a driver bar assembly according to the invention.

Turning now the drawings in detail, in FIG. 1 shaker 10 having a shaker head 12 rests on trunnions 14 above the floor 16. The shaker 10 and its head 12 are pivotable angularly upward from the horizontal position shown about pivots 18, as indicated by the dash line 20.

A bearing table 22 also rests on floor 16 and comprises a mass such as concrete 24 in a housing 26, a granite block 28 on which slip plate 30 rests for controlled motion in a desired axis, carrying test piece 32 in fixture 34. Thusfar described the apparatus is conventional.

It is the standard practice in the vibration test industry to couple the slip plate 30 to the shaker head 12 with a driver bar. In the present invention a driver bar assembly is used rather than a conventional driver bar.

With reference to FIGS. 2 to 8, the driver bar assembly of the invention is shown to comprise a bar element 36 and a retainer element 38. The bar element 36 comprises a normally vertially disposed base 40 formed as a series of vertical triangular flanges 42 which are provided with bolt holes 44 into which bolts (not shown) extending normally from shaker head 12 are passed to be secured with nuts (not shown). Bolt patterns on shaker heads vary, and it is desirable to have a vertically and horizontally distributed plurality of fastening locations of the base 40 to the shaker head 12 for fidelity in transmission of vibration. The bar element 36 further comprises a normally horizontally disposed flange 46 welded to or otherwise integral with the base 40. Flange 46 is provided with a first series of fastener apertures 48 into which bolts (not shown) are placed for purposes to be explained hereinafter. An additional series of apertures much greater in diameter is also provided, indicated at 50, FIG. 8, for purposes of holding vibration transmitting split sleeve pins as will be hereinafter more fully described.

It will be noted, FIG. 1, that the flange 46 is foreshortened so as to be spaced from the slip plate 30 a small distance and is carried by the base 40 to be in a common plane with the slip plate. Importantly, this common plane arrangement enables center line to center line driving of the slip plate 30 by the shaker head 12, and the absence of pitch moments which may occur in the shaker head mounting when the slip plate and shaker head are not in the same center line planes.

The retainer element 38 bridges the space between the flange 46 and the edge margin 52 of the slip plate 30. The retainer element 38 comprises an H-shaped body 54 having a first pair of legs 56, 58, and a second pair of legs 60, 62, which being cantilevered from the body center wall 64 and parallel define respectively a first bracket 66 and a second bracket 68. First bracket 66 is vertically dimensioned to slidably receive the flange 46. Second bracket 68 is vertically dimensioned to slidably receive the edge margin 52 of the slip plate 30. The ends of brackets 66, 68 are open enabling the endwise positioning of the retainer bar 38 between the slip plate 30 and the bar element 36 without relative movement between them, so that the bar element, and thus the shaker head 12 may be decoupled without unfastening the slip plate from the bearing table granite 28. The brackets 66, 68 are on the center line between the slip plate 30 and the shaker head 12, and being arranged to block pitch of the plate from both above and below, insure faithful replication of intended vibration forces in operation of the apparatus.

The driver bar element 36 is coupled to the flange 46 in bracket 66 through flange apertures 50 registered with opposed sets of apertures 70 in the legs 56, 58, by split sleeve pins 72 adapted to circumferential expansion by screwing, and known per se; similarly a further set of pins 72 are used to fasten the slip plate 30 in bracket 68 by passing through opposed sets of apertures 74 in the legs 60, 62 and registered apertures 76 in the slip plate 30. Pins 72 are vibration transmitting and thus the flange 46, bar element 36, retainer element 38 and the slip plate 30 are rigidly joined in vibration transmitting relation.

Figure 3:
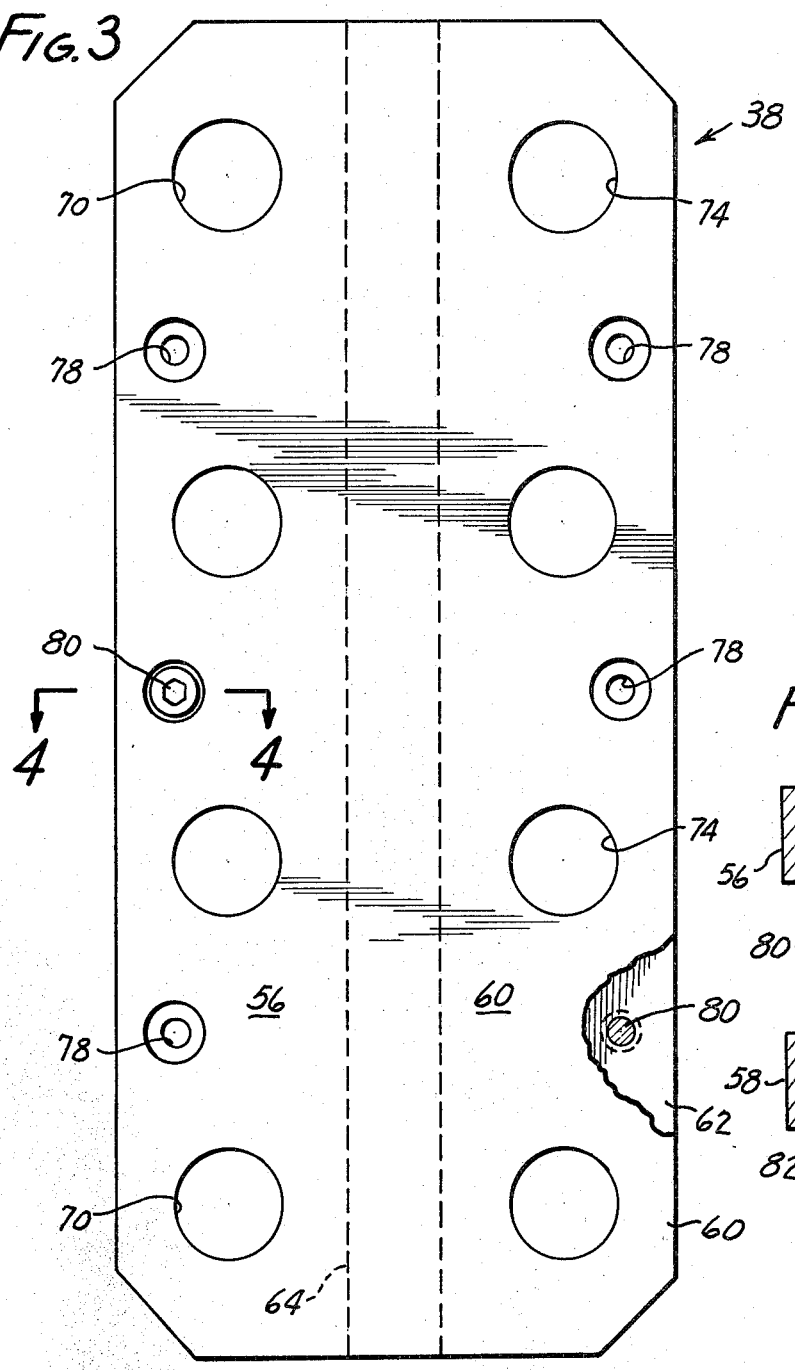
FIG. 3 is a plan view of the driver bar assembly retainer element, partly broken away to show underlying parts.
Figure 4:
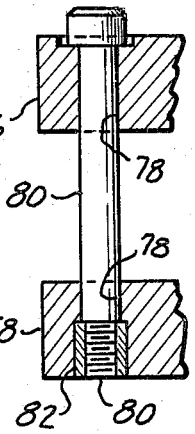
FIG. 4 is a fragmentary vertical sectional view taken on line 4—4 in FIG. 3.
Figure 5:
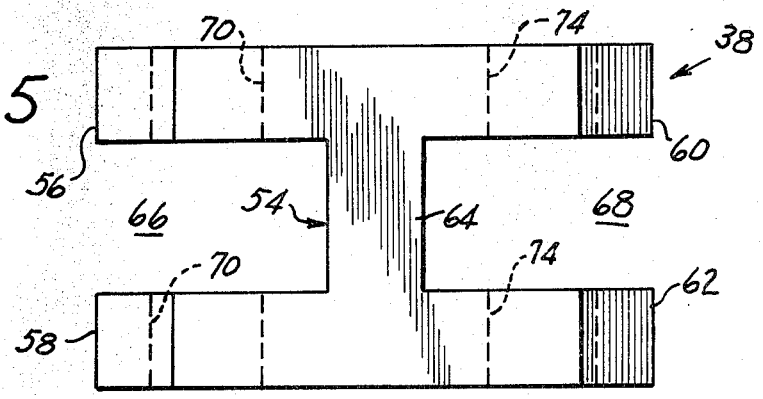
FIG. 5 is an end view of the driver bar assembly retainer element.
Figure 6:
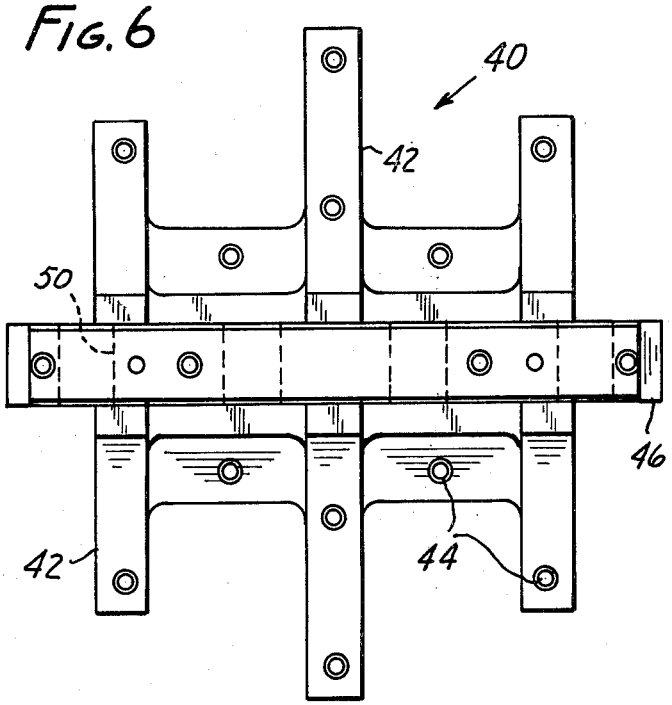
FIG. 6 is a front view of the driver bar assembly bar element.
Figure 7:
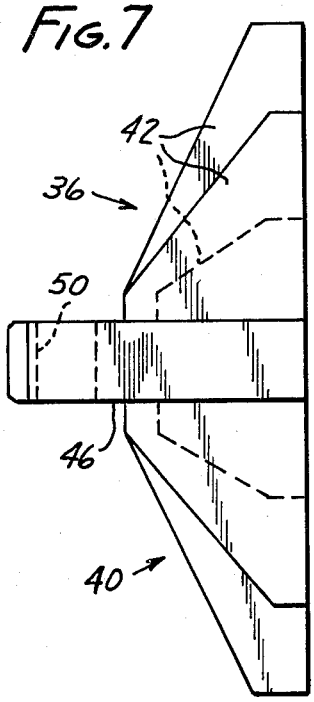
FIG. 7 is an end view of the driver bar assembly bar element.
Figure 8:
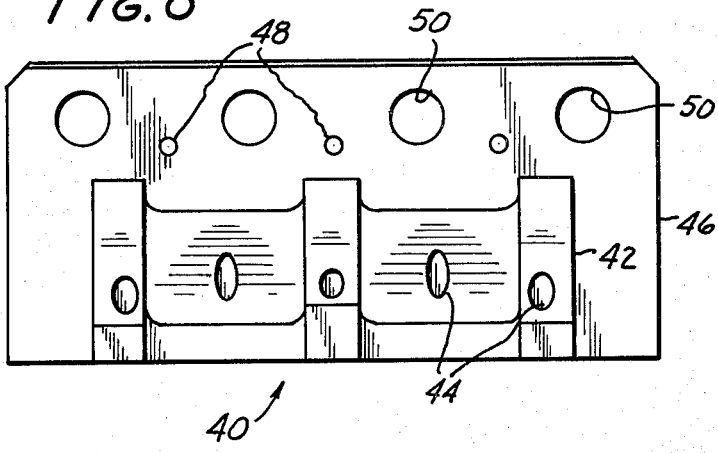
FIG. 8 is a top plan view of the driver bar assembly bar element.

Because resonant vibration may occur in the driver bar assembly, and produce untoward effects, the legs, 56–62 are provided with apertures 78 and therein additional fasteners 80, secured by threaded bushing 82 see FIGS. 3 and 8, (detail omitted in certain other Figures for clarity) which by fastening the legs to the bracketed flange 46, by passage through apertures 48 therein, and like apertures not shown in plate edge margin 52, damps resonant vibration and blocks spurious signal generation.

The objects of the invention are thus met including provision of a driver bar assembly which enables center line to center line driving of a slip plate by a shaker head, while permitting angular movement of the shaker head upon easy removal of the driver bar assembly retainer element without necessity of altering the fastening of the slip plate to the bearing table, or need to displace the shaker or bearing table.

I claim:

1. Driver bar assembly comprising a bar element and a retainer element separably connected thereto; said bar element having a normally vertically disposed base attachable to a pivotally mounted shaker head and a normally horizontally disposed flange adapted to lie in a common plane with and spaced from a slip plate to be driven by said shaker head; said retainer element having first bracket means in which said bar element flange is bracketable, and second bracket means in which said slip plate is bracketable opposite said bar element flange, whereby said flange and slip plate spacing is bridged in vibration transmitting relation between said shaker head and said slip plate; said retainer element being separable from said slip plate and said bar element flange without relative movement of said slip plate and shaker head, said bar element and shaker head being freely angularly movable relative to said slip plate in the separated condition of said retainer element and said bar element.

2. Driver bar assembly according to claim 1, in which said bar element base defines a distributed plurality of fastening means vertically spaced from said flange for fastening together said bar element base and said shaker head.

3. Driver bar assembly according to claim 1, in which said bar element flange and said retainer element define mutually registerable cooperating fastening means.

4. Driver bar element according to claim 1, in which said retainer element defines fastening means registerable and cooperative with slip plate fastening means.

5. Driver bar assembly according to claim 1, in which said retainer element comprises a body having an H-shaped cross-section, said first and second brackets being defined by respective pairs of the legs of the body.

6. Vibration test apparatus comprising the driver bar assembly according to claim 1, and including also a shaker head attached to said driver bar assembly in vibration transmitting relation.

7. Vibration test apparatus comprising the driver bar assembly according to claim 1, and including also a slip plate attached to said driver bar assembly in vibration receiving relation.

8. Vibration test apparatus comprising the driver bar assembly according to claim 1, and including also a shaker head and slip plate coupled together in vibration transmitting relation by said driver bar assembly.

9. Driver bar assembly according to claim 1, in which said retainer element comprises a body, said retainer element first bracket means comprises a pair of laterally and longitudinally extended legs cantilevered in parallel from a first side of said body and relatively spaced to slidably bracket said bar element flange, said legs defining opposed sets of fastener pin receiving apertures arranged to register with cooperating pin passing apertures on said bar element flange, whereby said legs are fastenable in vibration transmitting relation to said bar element flange.

10. Driver bar assembly according to claim 1, in which said retainer element comprises a body, said retainer element second bracket means comprises a pair of laterally and longitudinally extended legs cantilevered in parallel from a second side of said body and relatively spaced to slidably bracket said bar element flange, said legs defining opposed sets of fastener pin receiving apertures arranged to register with cooperating pin passing apertures on an edge margin of said slip plate, whereby said legs are fastenable in vibration transmitting relation to said slip plate.

11. Driver bar assembly according to claim 1, in which said retainer element comprises an H shaped body, said retainer element first and second bracket means comprising laterally and longitudinally extended extended leg pairs oppositely cantilevered in parallel from first and second sides of said body and relatively sized and spaced to slidably bracket either said bar element flange or the edge margin of said slip plate, said leg pairs defining opposed sets of fastener pin receiving apertures arranged to register with cooperating pin passing apertures on said bar element flange or said slip plate edge margin bracketed thereby, whereby said body is leg-fastenable in vibration transmitting relation to said slip plate and said bar element.

12. Driver bar assembly according to claim 11, including also pins fastening said retainer bar, slip plate and bar element flange together in vibration transmitting relation respectively at said apertures.

13. Driver bar assembly according to claim 11 in which said retainer element is symmetrical about its longitudinal axis.

14. Driver bar assembly according to claim 13 in which said retainer element is symmetrical about its transverse axis.

15. Driver bar assembly according to claim 14, including also split sleeve pins fastening said retainer bar, slip plate and bar element flange together in vibration transmitting relation.

16. Vibration test apparatus comprising the driver bar assembly according to claim 14, and including also a shaker head attached to said driver bar assembly in vibration transmitting relation.

17. Vibration test apparatus comprising the driver bar assembly according to claim 14, and including also a slip plate attached to said driver bar assembly in vibration receiving relation.

18. Vibration test apparatus comprising the driver bar assembly according to claim 14, and including also a shaker head and slip plate coupled together in vibration transmitting relation by said driver bar assembly.

19. Driver bar assembly according to claim 14, in which said bar element base defines a horizontally and vertically distributed plurality of fastening apertures above and below said flange for receiving shaker head bolts for fastening together said bar element base and said shaker head.

20. Driver bar assembly according to claim 19, in which said retainer element is endwise slidable onto said bar element flange and off said flange freely of relative movement of said bar element and said slip plate.

21. Driver bar element according to claim 20, in which said retainer element is endwise slidable onto said slip plate edge margin and off said slip plate freely of relative movement of said slip plate and said bar element.

* * * * *